US006572092B2

(12) United States Patent
DuVernay et al.

(10) Patent No.: US 6,572,092 B2
(45) Date of Patent: Jun. 3, 2003

(54) WORK HOLDING FIXTURE

(75) Inventors: Daniel J. DuVernay, Cottrellville, MI (US); Brad L. Siemen, Port Huron, MI (US)

(73) Assignee: Autocraft Tool & Die, Algonac, MI (US)

( * ) Notice: Subject to any disclaimer, the term of this patent is extended or adjusted under 35 U.S.C. 154(b) by 0 days.

(21) Appl. No.: 09/825,900

(22) Filed: Apr. 4, 2001

(65) Prior Publication Data

US 2001/0048188 A1 Dec. 6, 2001

Related U.S. Application Data

(60) Provisional application No. 60/195,712, filed on Apr. 7, 2000.

(51) Int. Cl.[7] ..... B25B 1/22
(52) U.S. Cl. ..... 269/71; 269/17; 269/296
(58) Field of Search ..... 188/31, 60, 180; 269/71, 296, 289 R, 76, 51, 17

(56) References Cited

U.S. PATENT DOCUMENTS 1,812,585 A * 6/1931 Collins ..... 269/71
2,470,487 A 5/1949 Hollis
2,741,830 A * 4/1956 Lewis ..... 269/71
2,991,994 A 7/1961 Kulp
3,218,056 A * 11/1965 Kaplan et al. ..... 269/71
3,700,228 A * 10/1972 Peale ..... 269/71
4,691,904 A 9/1987 Armstrong
5,156,382 A 10/1992 Saeda et al.
5,692,738 A 12/1997 Duvernay et al.
6,113,090 A * 9/2000 Hui ..... 269/902
6,173,947 B1 * 1/2001 Johnson ..... 269/71

* cited by examiner

*Primary Examiner*—Lee Wilson
(74) *Attorney, Agent, or Firm*—Dykema Gossett PLLC

(57) ABSTRACT

A work holding fixture includes a support frame having a first and a second side member. The first and second side members are connected by a connecting member. Fixed to the first side member is a fixture brake, with a shaft rotatably mounted relative to the first side member. A brake barrel assembly is mounted to one of the first and second side members. The brake barrel assembly has a barrel portion fixed to one of the first and second side members, and has a backing plate rotatably mounted to the one of the first and second members, and is in axial alignment with the fixture brake shaft. The backing plate has a feature which slidably receives a first bracket. The first bracket is configured for attachment to a work piece received by the backing plate. A tail stock assembly, with a drum portion and a bracket guide, is rigidly mounted to the other of the first and second side members. The tail stock assembly slidably receives a second bracket. The second bracket is configured for attachment to a work piece received by the tailstock assembly.

9 Claims, 5 Drawing Sheets

WORK HOLDING FIXTURE

RELATED APPLICATIONS

This application claims the benefit of provisional U.S. Application Ser. No. 60/195,712 filed Apr. 7, 2000.

BACKGROUND OF THE INVENTION

1. Technical Field

This invention relates to work holding fixtures, and more particularly to fixture brakes for rotatably positioning a work piece.

2. Discussion of the Background Art

When assembling certain large work pieces, it is highly desirable to have a fixture facilitating rotation of the work piece to desired angular positions. Motor vehicle instrument panels (IPs), for example, need to be worked on from both a front side, which is normally presented to the vehicle operator, and a back side, which is normally hidden from view once the IP is installed.

Known work holding fixtures used with IPs provide the desired rotation of the IP about a lateral axis. However, it is further desired to be able to easily transfer IPs from shipping racks to the work fixtures, or vice-versa. Known fixtures do not adequately facilitate this type of transfer.

It is therefore desired to provide a mechanism which facilitates the easy movement of an IP to and from a shipping rack relative to a work fixture while enabling rotation of the IP in the work fixture.

SUMMARY OF THE INVENTION

A work holding fixture includes a support frame having a first and a second side member. The first and second side members are connected by a connecting member. Fixed to the first side member is a fixture brake, with a shaft rotatably mounted relative to the first side member. A brake barrel assembly is mounted to one of the first and second side members. The brake barrel assembly has a barrel portion fixed to one of the first and second side members, and has a backing plate rotatably mounted to the one of the first and second members, and is in axial alignment with the fixture brake shaft. The backing plate has a feature which slidably receives a first bracket. The first bracket is configured for attachment to a work piece received by the backing plate. A tail stock assembly, with a drum portion and a bracket guide, is rigidly mounted to the other of the first and second side members. The tail stock assembly slidably receives a second bracket. The second bracket is configured for attachment to a work piece received by the tailstock assembly.

The brake barrel assembly may also have a spring loaded detent device mounted to one side for locking engagement with the backing plate.

The drum portion may include a guide positioned for receipt and rotation of the second bracket. The drum portion may also contain an opening at one end with a bracket guide extending from the opening. The bracket guide is used as a funnel for receipt and rotation of the second bracket. A roller pocket guide maybe positioned in the drum portion such that a radial gap of a predetermined size exists between the outer diameter of the roller pocket guide and inner diameter of the drum portion. The second bracket may also have rollers mounted thereto for receipt and rotation in the roller pocket guide. The roller pocket guide allows for ease in rotation.

A brake barrel assembly includes a barrel portion with an axially extending arcuate wall and a receiving slot through the wall. A backing plate is rotatably connected to the barrel portion and has a slot feature which slidably receives a bracket. The bracket is configured for attachment to a work piece that is received by the backing plate. The slot feature is aligned with the receiving slot when in the first position. A spring loaded detent device is mounted on one side of the brake barrel lockingly engaging the backing plate in a first position.

The spring loaded detent device may also contain a plunger assembly. The plunger assembly has a plunger housing that is mounted to the brake barrel assembly, a plunger roller tip that is received by a notch in the backing plate in the first position, and, a plunger spring which biases the plunger roller tip into engagement with the notch.

The slot feature may be further defined by two slot brackets that are configured for attachment to the backing plate. The slot brackets may also have chamfered surfaces that extend outwardly from the slot feature into approximate alignment with the receiving slot facilitating receipt of the bracket. A sliding bracket may be disposed in the slot feature and sized for a slidable fit between the slot brackets. The sliding bracket has a first end in approximate alignment with the inner diameter of the barrel portion to maintain the relative position of the sliding bracket and the slot brackets with rotation of the backing plate.

A work holding fixture in accordance with the present invention represents a significant improvement as compared to conventional work holding fixtures. The present invention allows for easy rotation of the work piece to desired angular positions. The present invention also allows for easy transfer from shipping racks to work fixtures, or vice-versa.

These and other features and objects of this invention will become apparent to one skilled in the art from the following detailed description and the accompanying drawings illustrating features of this invention by way of example.

DETAILED DESCRIPTION OF THE PREFERRED EMBODIMENTS

Figure 1:
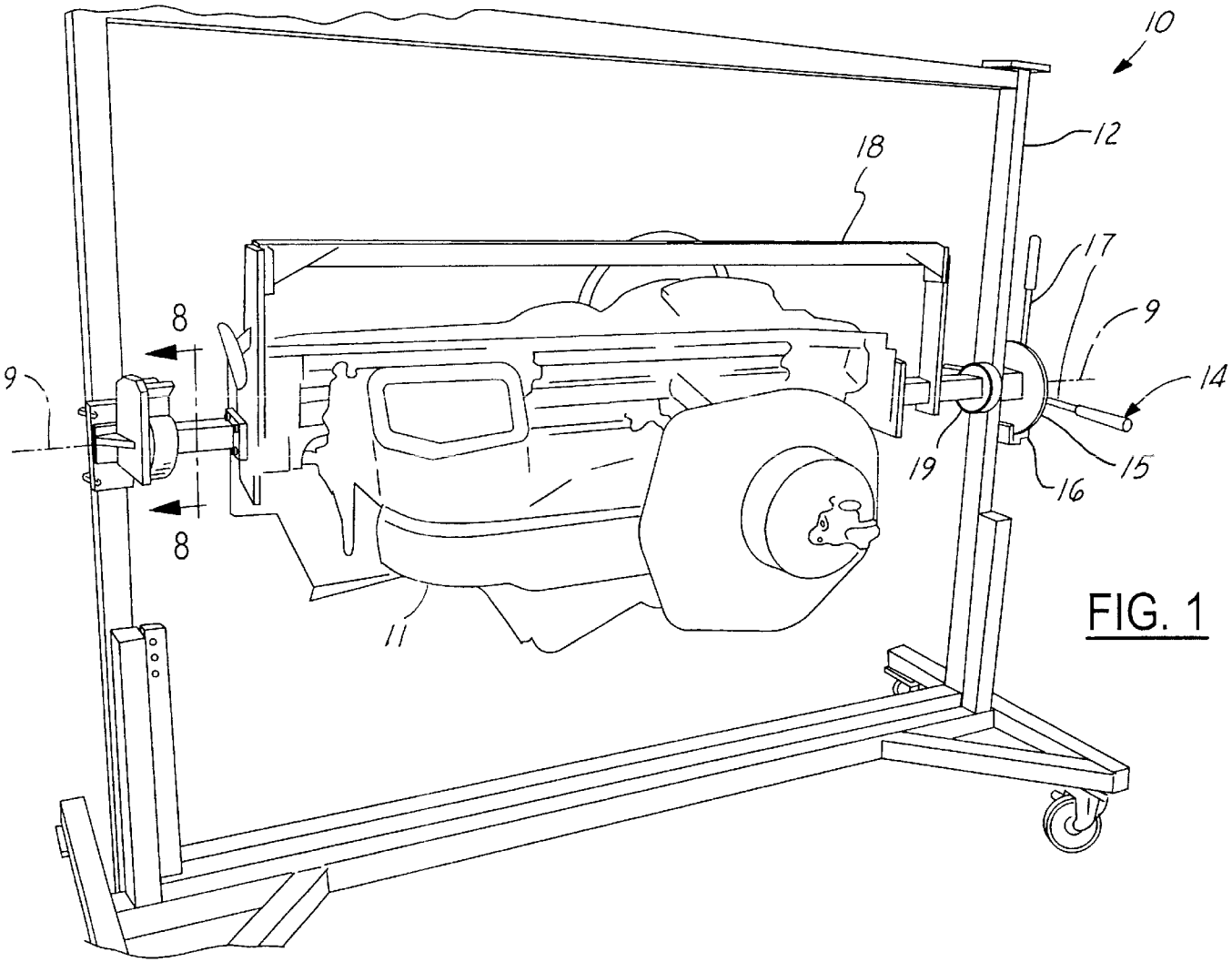
FIG. 1 is a perspective view of a work frame fixture in accordance with the present invention.

A work fixture 10 as shown in FIG. 1 supports an exemplary work piece, an instrument panel (IP) 11 for rotation about a transverse axis of rotation 9. The work fixture 10 includes a support frame 12 and casters 13. Alternatively, support frame 12 could be configured to be suspended from an overhead conveyor instead of the caster supported configuration shown.

A fixture brake 14 is mounted to the right-hand side of support frame 12, as shown in FIG. 1, for the purpose of controlling the angular position of IP 11. A preferred fixture brake 14 is disclosed in U.S. Pat. No. 5,692,738, which is assigned to the assignee of the present invention. U.S. Pat. No. 5,692,738 and the teachings therein are hereby incorporated by reference thereto. Fixture brake 14 includes a brake disc 15 fixed to frame 12. A clamping assembly 16 which includes handles 17, is rotatively fixed to a sub-frame 18 for rotation therewith, and for rotation with IP 11, after sub-frame 18 has been installed as described below.

Figure 2:
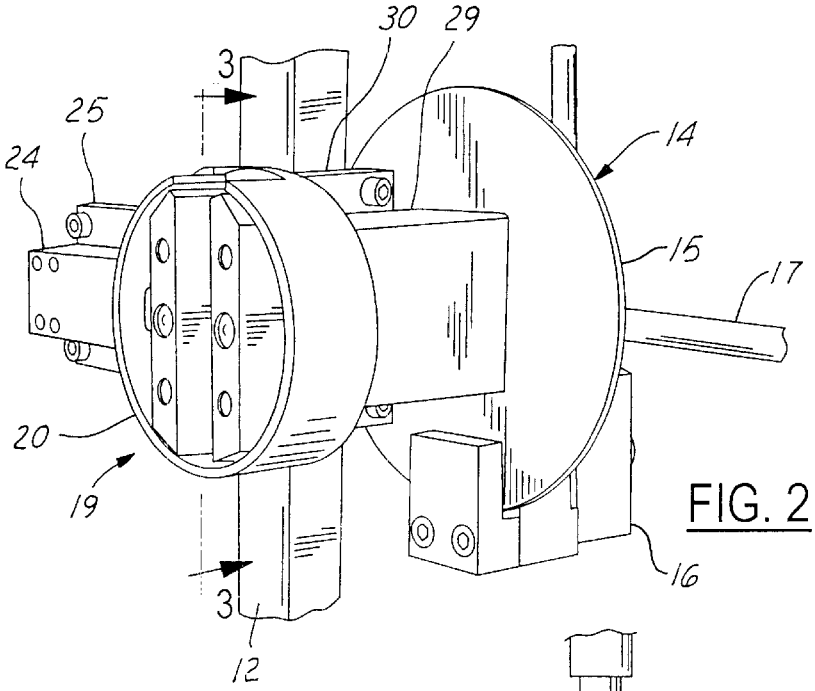
FIG. 2 is an enlarged perspective view of a brake and brake barrel assembly of the fixture of FIG. 1.
Figure 3:
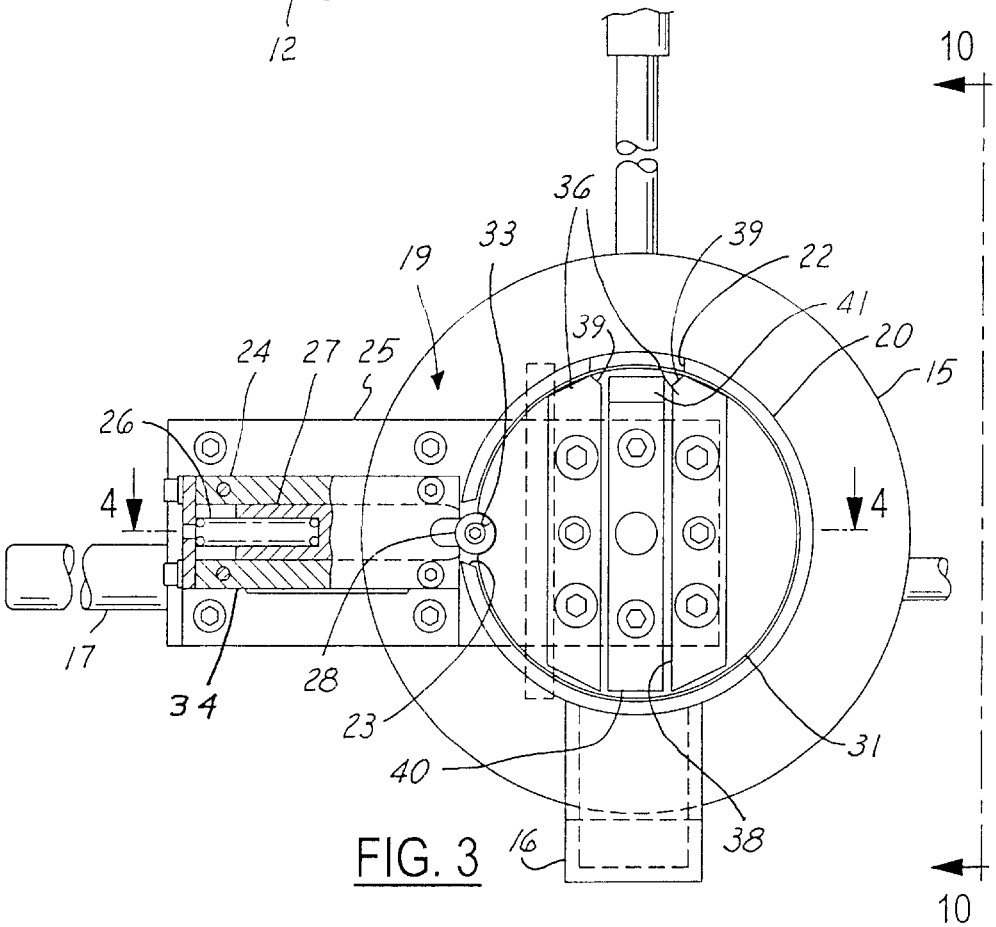
FIG. 3 is an end view of the brake barrel assembly taken in the direction of arrows 3 of FIG. 2.
Figure 4:
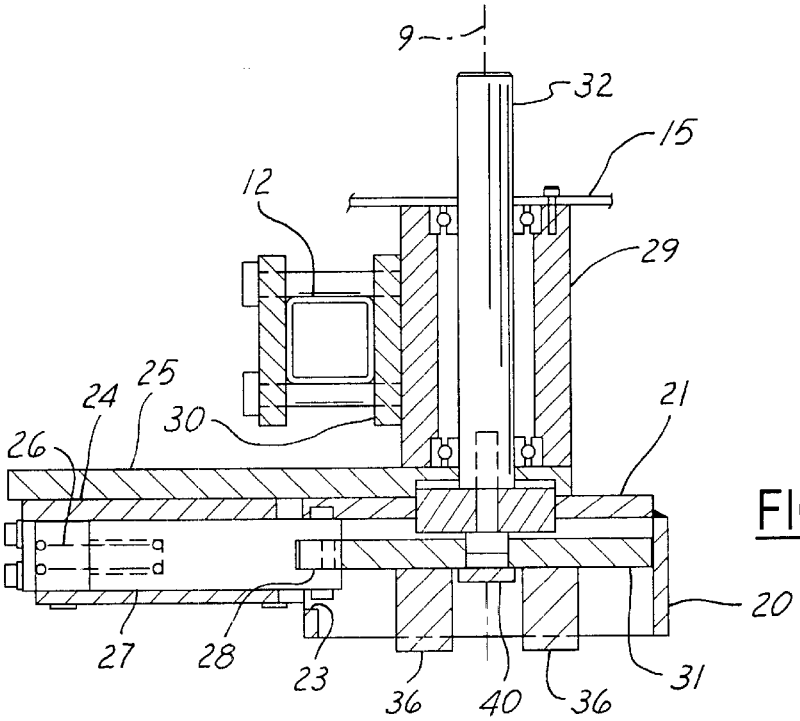
FIG. 4 is a sectional view of the brake barrel assembly taken in the direction of arrows 4 of FIG. 3.

Also mounted to the right-hand side of support frame 12 is a brake barrel assembly 19, best shown in FIGS. 2–4. A cylindrical barrel portion 20, substantially defined by an axially extending arcuate wall, is welded to an end plate 21 which substantially closes an end of barrel portion 20. Cylindrical barrel portion 20 is centered on axis 9, and has a first or receiving opening 22 through an upper portion thereof.

Barrel portion 20 has a second or plunger opening 23 in a location approximately 90° from the first opening 22. A plunger assembly 24 is fixed to barrel portion 20, and aligned with plunger opening 23.

Plunger assembly 24 is fixed to barrel portion 20 via a plunger mounting plate 25. Plunger mounting plate 25 is rigidly connected to both plunger assembly 24 and end plate 21. Plunger assembly 24 has a plunger housing 34 which encloses a plunger spring 26 and a plunger 27. Plunger 27 has a roller tip 28 rotatively disposed at an end thereof. Spring 26 biases roller tip 28 through plunger opening 23.

Brake barrel assembly 19 and brake disc 15 are fixed to each other by an intermediate connecting tube 29 disposed between mounting plate 25 and disc 15. Connecting tube 29 is shown as having a rectangular shape, but can be of any alternative shape. A mounting flange 30 is fixed to connecting tube 29 intermediate between end plate 21 and brake disc 15. Mounting flange 30 is fixed to support frame 12, thereby fixing both brake disc 15 and barrel portion to support frame 12.

A backing plate 31 is rotatably mounted within barrel portion 20 and rotatably fixed to a rotating shaft 32 of brake 14. Shaft 32 is centered on axis 9. Shaft 32 passes through end plate 21 and brake disc 15 and is fixed to clamping assembly 16. Bearings disposed within intermediate connecting tube 29 as shown in FIG. 4 rotatively support shaft 32. Backing plate 31 rotates as a unit with shaft 32 and clamping assembly 16. Backing plate 31 has a radiused notch 33 which receives, in a first position, roller tip 28. Notch 33, best shown in FIG. 3, has a chamfered lead on both the leading and trailing edges to facilitate entry of and exit of roller tip 28 to and from notch 33. Spring 26 biases plunger roller tip 28 into engagement with notch 33. The resultant engagement maintains backing plate 31 in a first or upright position as shown in FIG. 3.

A pair of slot brackets 36 are rigidly mounted to backing plate 31, within barrel portion 20, for rotation with backing plate 31. Slot brackets 36 define a slot 38 therebetween of a predetermined width. Slot 38 is aligned with receiving opening 22 in the first position. Brackets 36 have chamfers 39 which serve to extend the width of slot 38 to equal the width of opening 22 at a location proximate to opening 22. A rub plate 40 is disposed between brackets. Rub plate 40 also has a chamfer 41.

Figure 10:
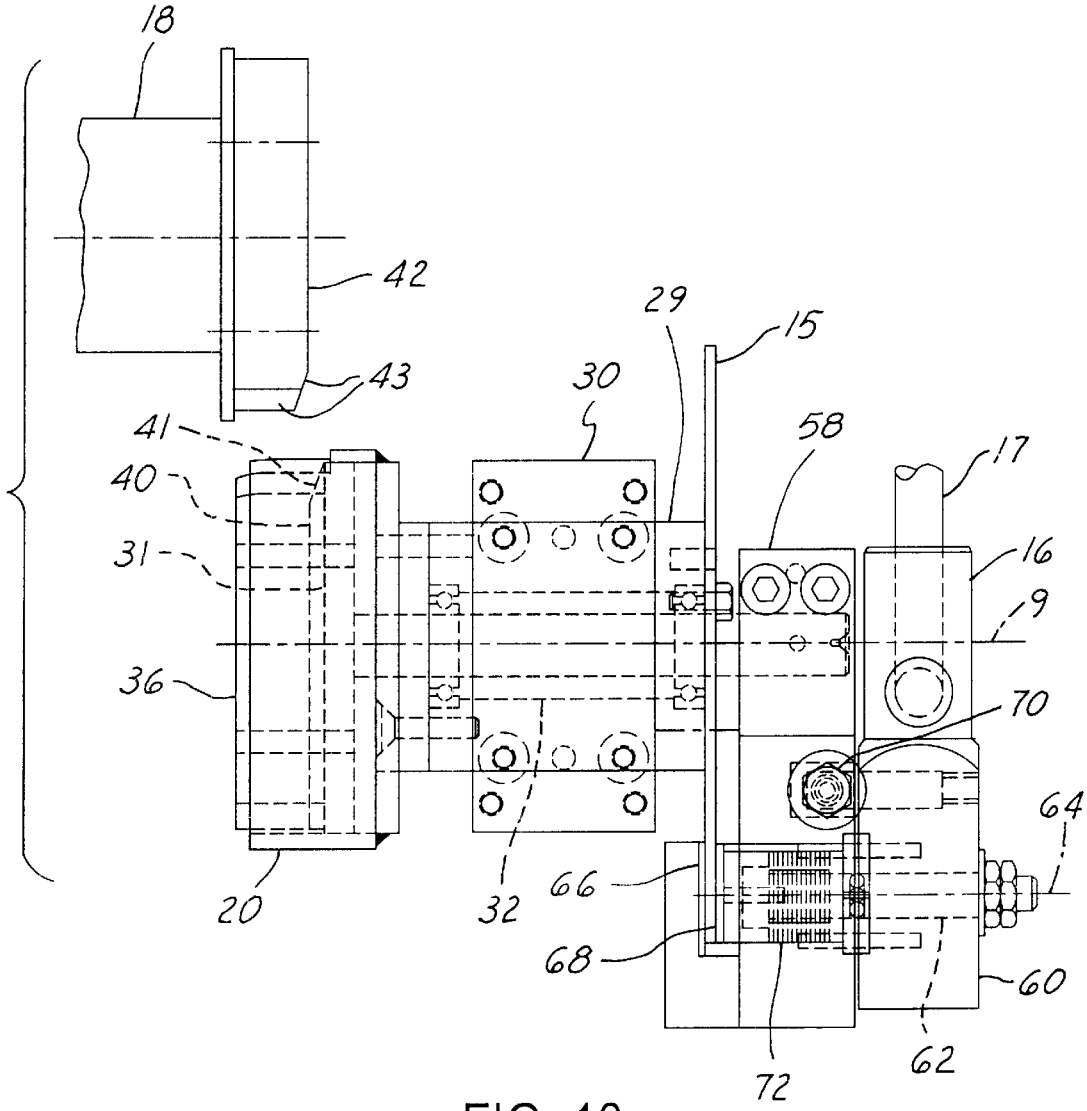
FIG. 10 is a side view of the brake barrel assembly and the fixture brake of FIG. 3 in the direction of arrows 10.

Sub-frame 18 is configured for mounting to IP 11, and is mounted thereto as shown in FIG. 1. At an extreme right end of sub-frame 18 as shown in FIG. 1, sliding bracket 42, best shown in FIG. 10, is fixedly mounted thereto. In FIG. 10, sub-frame 18 is poised above barrel assembly 19 for installation therein. Sliding bracket 42 has leading chamfers 43. An intermediate plate is disposed between sliding bracket and sub-frame 18. The end plate is in the form of a circular disc to substantially close the open end of barrel portion 20 when the IP 11 is installed in fixture 10. Sliding bracket 42 is sized to slidably fit within slot 38. Sliding bracket 42 is also sized for rotation within barrel portion 20. Sliding bracket 42, in the form illustrated, must have a length no greater than an inside diameter of barrel portion 20. In an installed condition, it is important that an end of sliding bracket 42, shown as uppermost in FIG. 10, be proximate to the inside diameter of barrel portion 20 so as to maintain the desired orientation of sub-frame 18 relative to support frame 12 with rotation of sub-frame 18 and IP 11. It should be appreciated that a shorter version of bracket 42 could be employed in combination with a travel limit or stop disposed between brackets 36.

Figure 5:
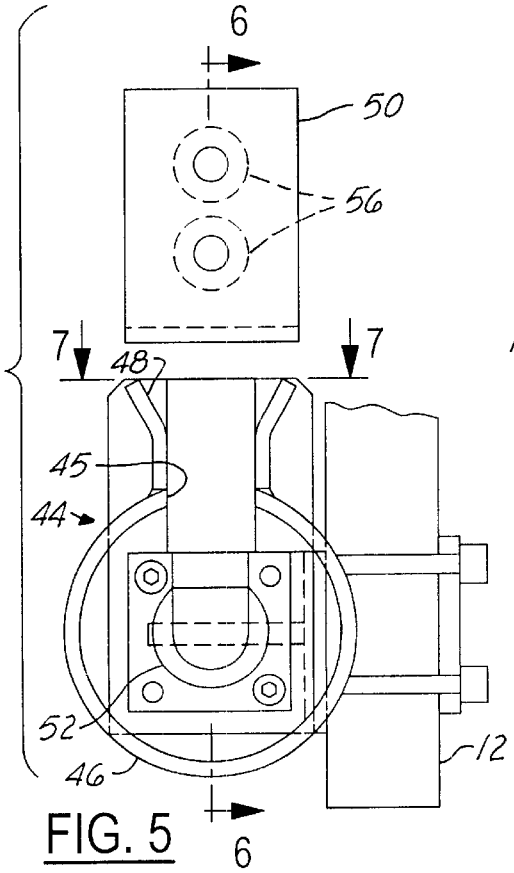
FIG. 5 is a view of a tail stock assembly of the fixture in the direction of arrows 5 of FIG. 1 with a roller bracket poised for installation.
Figure 6:
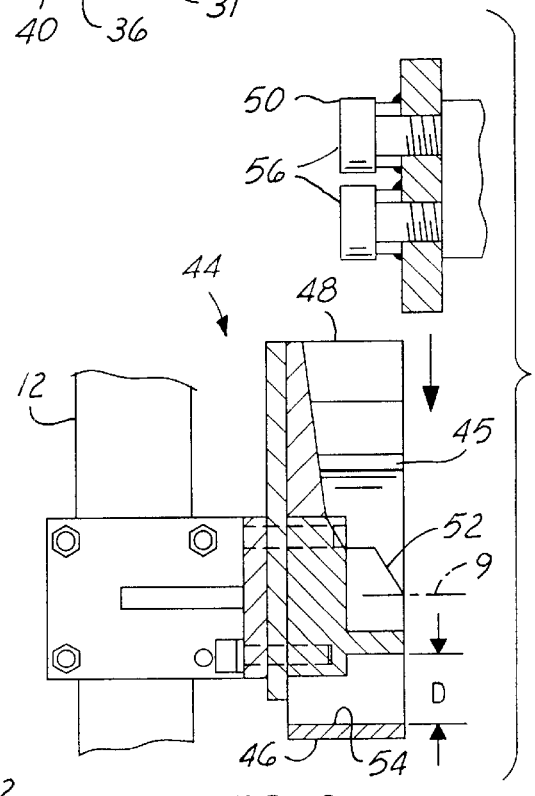
FIG. 6 is a partial sectional side view of the tail stock assembly in the direction of arrows 6 of FIG. 5.
Figure 7:
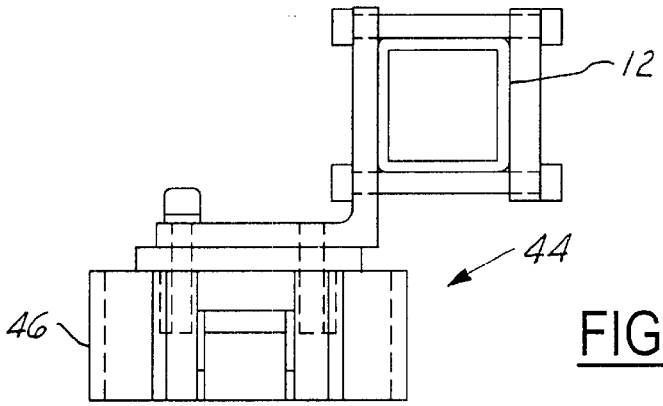
FIG. 7 is a top sectional view of the tail stock assembly in the directions of arrows 7 of FIG. 5.

A tailstock assembly 44, best shown in FIGS. 5–9 is rigidly mounted to the left-hand side of support frame 12 as shown in FIG. 1. A cylindrical drum portion 46 of assembly 44 has an opening 45 at a top end. A bracket guide 48 extends from the opening 45 and serves as a funnel for receiving rollers 56. Rollers are rotatively mounted to, and extend from, a roller bracket 50 as best shown in FIGS. 5 and 6. A roller pocket 52 is centered in drum portion 46 and receives one of the rollers 56. Roller pocket 52, and hence the roller 56 disposed therein, are co-axial with an axis of shaft 32. There is a radial gap 54 between the outer diameter of roller pocket 52 and the inner diameter of drum portion 46 of a predetermined size D which receives the other of the rollers 56.

Roller bracket 50 is rigidly mounded to the extreme left end of sub-frame 18 as shown in FIG. 1.

Figure 8:
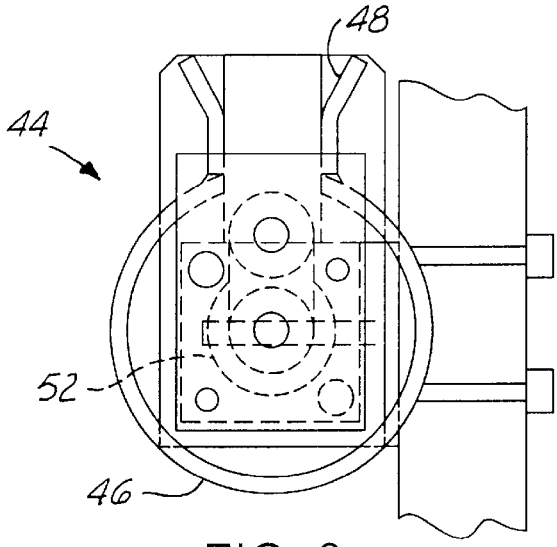
FIG. 8 is an end view of the tail stock assembly in the direction of arrows 8 of FIG. 1.
Figure 9:
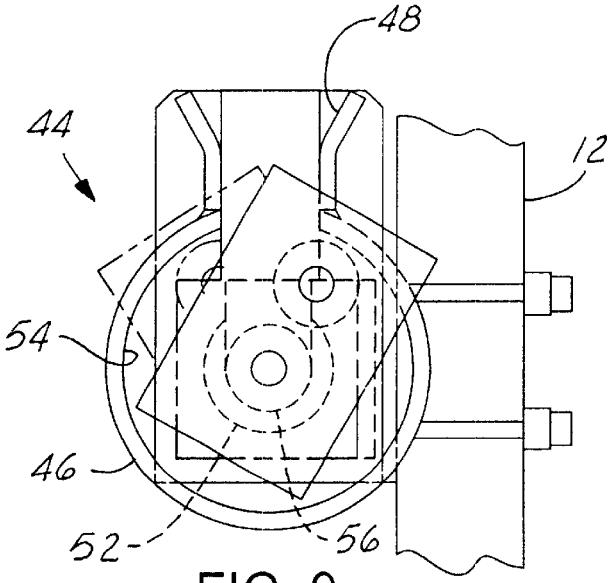
FIG. 9 is a view of the tail stock assembly of FIG. 8 with the roller bracket rotated from the initial installed position.

In an installed condition, shown in FIGS. 8 and 9, one of rollers 56 is disposed in roller pocket 52, and the other is disposed in the radial gap 54. The sliding bracket 42 is disposed in slot 38. With brackets 42 and 50 so engaged, the IP 11, together with sub-frame 18 can be rotated about the axis on which backing plate 31 is rotatably mounted by exerting a force on a brake handle 17 to release brake 14. Movement of rollers 56 out of the tailstock assembly 44 is prevented during rotation of IP 11 by engagement between the reactive force of pocket 52 against the roller 56 disposed therein, and by engagement of the roller 56 in radial gap 54 against one or both of an outer diameter of pocket 52 and the inner diameter of drum portion 46.

To remove IP 11 from or to install IP 11 in support frame 12, the backing plate 31 must be first rotated to the initial installed, or lock position, where plunger roller tip 28 engages notch 33. With the backing plate 31 so oriented, sliding bracket 42 is aligned with the receiving opening 22 in barrel portion 20, and rollers 56 are aligned with opening 45 and bracket guide 48. IP 11 and sub-frame 18, along with brackets 42 and 50 may then either be lowered into or lifted out of engagement with support frame 12.

In the illustrated embodiment, rollers 56 are each the same size, and a radius of roller pocket 52 is approximately equal to the radius of rollers 56. Additionally, the size D of radial gap 54 is approximately equal to the diameter of rollers 56. Size D of radial gap 54 is slightly larger than the diameter of rollers 56 to permit rollers 56 to move freely within gap 54. It should be appreciated that the rollers need not be the same size. It should also be appreciated that rollers 56 could potentially be significantly smaller than their respective receiving gaps or pockets. However, such a discrepancy may result in less than optimal performance.

The rotating shaft 32 of brake 14 is centered on axis of rotation 9 which passes through the barrel portion 20 of brake barrel assembly 19 as best shown in FIG. 10. A first brake block 58 is fixed to the rotating shaft of brake 14 by the clamping action induced by clamping fasteners which draw together a split end of first block 58.

First block 58 and second block 60 are pivotally attached to each other by a pivot shaft 62 at a second axis of rotation 64 offset from first axis of rotation. Operation of fixture brake 14 is enhanced if second axis 64 is substantially parallel to first axis 9.

Three handles 17 are each disposed in bores in the second block 60 and are fixed therein by set screws.

A first friction pad 66 is fixed to a first friction pad backing plate, mounted to an axial extension of first block 58 to define a gap between the first friction pad and the rest of first block 58. The gap receives brake disc 15. A second friction pad 68 is fixed to a second friction pad backing plate which is in turn fixed to the pivot shaft and is located within gap A, opposite the first friction pad, and on a second side of brake disc 15.

A positioning nut 70 is disposed on a threaded end of the pivot shaft and limits the axial travel of the pivot shaft and, therefore, the second friction pad toward brake disc 15 and the first friction pad. A locking nut tightened against the positioning nut fixes the positioning nut in place on the pivot shaft. Eight diaphragm springs 72 are disposed over the pivot shaft between the second friction pad and first block 58, thereby biasing the second friction pad toward brake disc 15. Springs 72 are located within a cavity in first block 58 which opens toward gap A. A thrust bearing is disposed between the positioning nut 70 and second block 60 to sustain the axial loads induced by the diaphragm springs and to enable relative rotation between second block 60 and the positioning nut 70.

In commercial use, sub-frame 18 is fixed to an IP 11. Sliding bracket 42 and roller bracket 50 are in fixed to the ends of the IP 11 through sub-frame 18. Optimal attachment of sub-frame 18 to the IP 11 would be such that when sub-frame 18 is attached to support frame 12 of work fixture 10, the IP 11 is in the upright position, and axis 9 passes through or near the center of mass of the assembly of IP 11 and sub-frame 18. The upright position substantially corresponds to the in-vehicle installed orientation of IP 11. However, this orientation is not critical and the IP 11 could be attached to sub-frame 18 such that attachment to support frame 12 of work fixture 10 results in IP 11 at a different position than upright. IP 11 is then mounted onto work fixture 10 by lowering sliding bracket 42 into slot 38 and rollers 54 into tailstock assembly 44. As work fixture 10 is moved through the build process, the IP 11 is rotated by an operator as necessary for the installation of various parts. The IP 11 is rotated by the operator applying a force against handles 17 in the direction of desired rotation. The force will overcome the detent mechanism, thereby moving the IP 11 from the initial or lock position. Handles 17 are rotated by the operator until the IP 11 has reached the desire angle and then force on handles 17 is released and the IP 11 is again locked in place by the friction pads 66 and 68 of brake 14 engaging disc 15. This process can be repeated, enabling the IP 11 to be positioned at any angle best suited for performing work on the IP 11. Once the assembly of IP 11 is complete, IP 11 can be returned to its upright position by again applying the necessary force on handles 17, and rotating IP 11 to the upright position. The release of force on handles 17 will again cause brake 14 to lock IP 11 rotatively in relative to work fixture 10.

Work fixture 10 can be moved to various work stations via rolling it on casters 13 on support frame 12 or by mounting support frame 12 onto an assembly line, or by any other method that allows for easy rotation of IP 11 and movement of work fixture 10.

It is to be understood that the above description is merely exemplary rather than limiting in nature, the invention being limited only by the appended claims. Various modifications and changes may be made thereto by one of ordinary skill in the art which embody the principles of the invention and fall within the spirit and scope thereof. For example, while fixture brake 14 is a preferred actuating means, or means of providing selective rotation and preventing undesired rotation of the IP 11 and sub-frame 18 assembly, it is not the only possible actuating means. One alternative actuating means would be to employ a motor driven worm gear which would rotatively displace a pinion gear on shaft 32. The worm gear would prevent the pinion gear from rotating when not rotating. Rotation of the worm gear in either a clockwise or counterclockwise direction would rotate IP and sub-frame in corresponding directions. It is appreciated that the interface between sub-frame 18 and support frame 12 as describe above provide a driving connection between sub-frame 18 and the actuating means 14 necessary to the operation of the invention. Such an engagement is advantageously achieved in the present invention by merely lowering the assembled sub-frame and IP into engagement with receiving features, tailstock 44 and brake barrel assembly 19. Rollers 56, as engaged with tailstock assembly 44 enable rotation at one end. Bearings supporting shaft 32 enable rotation at the other end of sub-frame 18. The key-type arrangement, with sliding bracket 42 trapped on the between slot brackets 36 is one way of achieving the desired driving connection between sub-frame 18 and actuating means 14. However, a plurality of rollers could be substituted for sliding bracket 42. Or, alternatively, slot brackets 36 could be fixed to subframe 18, and sliding bracket 42 mounted to support frame. Further, the free rotation provided on the tailstock end could alternatively be provided by a single roller. The tailstock could employ a feature such as a hinged cover which could be selectively engaged with roller 56 once roller 56 is placed in pocket 52. It should be appreciated that these alternatives are merely exemplary, and are not intended to be comprehensive.

We claim:

1. A work holding fixture, comprising:

a support frame having first and second side members connected by a connecting member;

a fixture brake having a shaft rotatably mounted relative to said first side member;

a brake barrel assembly mounted to one of said first and second side members and having a barrel portion fixed to the one of the first and second side members, a backing plate rotatably mounted to the one of the first and second side members and in axial alignment with the fixture brake shaft, and the backing plate having a feature which slidably receives a first bracket and the first bracket configured for attachment to a work piece received by the backing plate;

a tail stock assembly having a drum portion and a bracket guide, said tail stock assembly rigidly mounted to the other of the first and second members which slidably receives a second bracket; and the second bracket configured for attachment to a work piece and being received by the tailstock assembly.

2. The fixture of claim 1 wherein said brake barrel assembly has a spring loaded detent device mounted to one side of said brake barrel assembly for locking engagement with said backing plate.

3. The fixture of claim 1 wherein said drum portion further includes a roller pocket guide positioned in said drum portion for receipt and rotation of said second bracket.

4. The fixture of claim 3 wherein said second bracket has rollers mounted thereto for receipt and rotation in said roller pocket guide.

5. A work holding fixture, comprising:

a support frame having first and second side members connected by a connecting member;

a fixture brake having a shaft rotatably mounted relative to said first side member;

a brake barrel assembly mounted to said first side member and having a barrel portion fixed to the first side member, a backing plate rotatably mounted to the first side member and in axial alignment with the fixture brake shaft, the brake barrel assembly having a spring loaded detent device mounted to one side for locking engagement with said backing plate, and the backing plate having a slot feature which slidably receives a first bracket and the first bracket configured for attachment to a work piece received by the backing plate;

a tail stock assembly rigidly mounted to the second member which slidably receives a second bracket, said tail stock assembly having a drum portion with an opening at one end, a bracket guide extending from the opening, said bracket guide used as a funnel for receipt and rotation of said second bracket, and a roller pocket guide positioned in the drum portion with a radial gap of a predetermined size existing between the outer diameter of the roller pocket guide and inner diameter of the drum portion; and, the second bracket configured for attachment to a work piece and being received by the tail stock assembly.

6. The fixture of claim 5 wherein said second bracket has rollers mounted thereto for receipt and rotation in said roller pocket guide.

7. The fixture of claim 5 wherein said slot feature is defined by two slot brackets configured for attachment to the backing plate.

8. The fixture of claim 7 wherein said slot brackets have chamfered surfaces extending outwardly from the slot feature into approximate alignment with the receiving slot feature facilitating receipt of said first bracket.

9. The fixture of claim 7 wherein a sliding bracket is disposed in the slot feature and is sized for a slidable fit between the slot brackets, having a first end in approximate alignment with the inner diameter of the barrel portion to maintain the relative position of the sliding bracket and the slot brackets with rotation of the backing plate.

* * * * *